United States Patent [19]

Brodeur et al.

[11] Patent Number: 4,480,554

[45] Date of Patent: Nov. 6, 1984

[54] ARTICULATED RAIL CAR FOR VEHICULAR TRAILERS

[76] Inventors: Rene H. Brodeur, 2108 Beechwood Ave., Wilmette, Ill. 60091; Boris S. Terlecky, 234 Lippincott La., Fox Lake, Ill. 60020; Ronald P. Sellberg, 5 S. 649 Wright, Naperville, Ill. 60540; William R. Halliar, 942 Pearl St., Whiting, Ind. 46394

[21] Appl. No.: 394,174

[22] Filed: Jul. 1, 1982

Related U.S. Application Data

[62] Division of Ser. No. 59,773, Jul. 23, 1979, Pat. No. 4,339,996.

[51] Int. Cl.[3] ..... B61F 3/00; B61F 5/22; B61F 5/32

[52] U.S. Cl. ..... 105/171; 105/165; 105/199 S; 105/453

[58] Field of Search ..... 105/3, 171, 199 S, 4 R, 105/165, 453

[56] References Cited

U.S. PATENT DOCUMENTS

| | | | |
|---|---|---|---|
| 2,900,924 | 8/1959 | Furrer et al. | 105/199 S |
| 2,961,974 | 11/1960 | Seelig et al. | 105/199 S X |
| 3,151,575 | 10/1964 | Dickey et al. | 105/199 S X |
| 4,091,739 | 5/1978 | Theurer et al. | 105/199 S X |
| 4,339,996 | 7/1982 | Brodeur et al. | 105/3 |

*Primary Examiner*—David A. Scherbel
*Assistant Examiner*—Howard Beltran
*Attorney, Agent, or Firm*—Haight, Holfeldt, Davis & Jambor

[57] ABSTRACT

A single axle railroad wheel truck is disclosed having two wheels joined by a single axle. A frame supported on the wheels and axle defines four spaced apart hanger flanges. A pair of cross members parallel to the axle for supporting a railroad car body are supported on pairs of hanger members directly connected between a pair of said hanger flanges and each one of the cross members. Springs are disposed upon the cross members for supporting a car body thereon.

1 Claim, 13 Drawing Figures

10
12
14
16
20
24
28
32
34
36
38
40
44
50
100
108
112
116

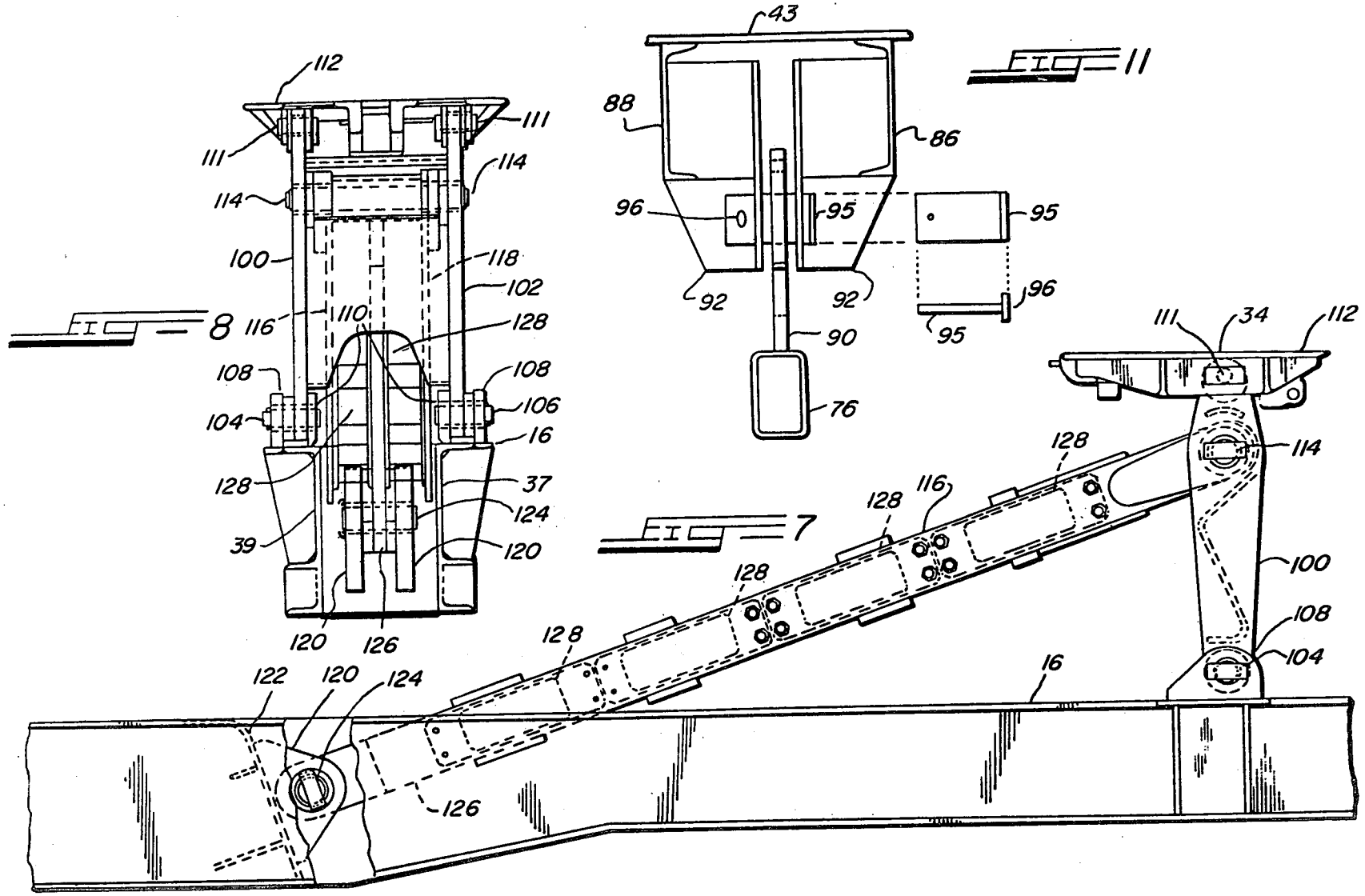
11
7
8
112
111
34
114
100
108
104
16
128
116
126
124
120
122
95
96
86
92
90
76
43
88
102
118
106
37
110
39

ARTICULATED RAIL CAR FOR VEHICULAR TRAILERS

This is a division of application Ser. No. 059,773, filed July 23, 1979, now U.S. Pat. No. 4,339,996 issued July 20, 1982.

BACKGROUND OF THE INVENTION

1. Field of the Invention

The present invention relates to railroad cars, and more particularly, to articulated rail cars for transporting wheeled vehicular trailers.

2. Description of the Prior Art

Because of the congestion of highways, and the increased expense of transporting goods over long distances by truck, the railroad industry has been able to increasingly compete with the trucking industry by transporting truck trailers "piggyback" on specially designed rail cars. Specially designed equipment has now been installed in major distribution points to physically lift truck trailers on to and off of rail cars at points close to the ultimate delivery destination of the contents of the trailer.

However, despite the increased costs of gasoline and diesel fuel, it is still desirable to be able to transport more than one truck trailer per freight car in order to establish economical freight rates which will induce truckers to use railroad facilities rather than highways. Typically smaller trailers have been transported by rail car because of the limited size of such prior art rail cars. For the larger motor truck trailers that are of a length of approximately 45 feet or more, suitable rail cars for transporting two such large trailers have heretofore not been available.

Accordingly, it would be a desirable advance in the art to provide a rail car capable of transporting two large wheeled vehicular trailers of a size of approximately 45 feet in length with nose mounted refrigeration units.

Description of the Invention

A centrally articulated rail car unit for transporting wheeled vehicular trailers comprises first and second car bodies each having forward and rearward ends. Single axle railroad wheel trucks are mounted at each of the forward and rearward ends of each of the first and second car bodies. A semi-permanent coupling connects the rearward end of the first car body with the forward end of the second car body for transmitting pulling and pushing forces between the car bodies and allowing articulation between the first and second car bodies. Disengageable couplings are respectively mounted on the forward end of the first car body and the rearward end of the second car body. These disengageable couplings permit coupling with compatible couplings on other rail cars in a train.

The first and second car bodies further comprise a central spine means which extends the entire length of the car bodies and upwardly between the wheels of the wheeled vehicular trailers for providing vertical strength and a force transmission path between the couplings. Tire support means extend horizontally from each side of the central spine means below the top of the central spine means for supporting the wheels of the vehicular trailer. A fifth wheel means is mounted on the spine means at one end of each of the car bodies for supporting the unwheeled end of the vehicular trailers.

To reduce the overall weight of the rail car and thereby increase the pay load that may be carried by the articulated rail car, the tire support means comprises a flat solid surface extending along the portion of the car body where the wheels of the vehicular trailer are to be supported and the remainder of the tire support means comprises a flat grated surface having regularly spaced holes therein to reduce weight. Further, because the disengageable coupling comprises a conventional draft gear mounted in the central spine means, the draft gear can be serviced and replaced by removing a cover along the top of the central spine means thereby facilitating and reducing the cost of maintenance. The fifth wheel means is non-retractable and comprises forced damping means to reduce the vibrational forces applied to the vehicular trailer during normal rail movement.

Accordingly, it is a primary object of the present invention to provide a centrally articulated rail car unit for transporting two large wheeled vehicular trailers while maintaining the normal number of axles for the railroad car unit.

Further, it is a principal object of the present invention to provide a low profile centrally articulated rail car unit for transporting two wheeled vehicular trailers of at least 45 feet in length on a single rail car unit.

Yet another object of the present invention is to provide a fifth wheel for a rail car that absorbs vibrational forces incident to rail travel.

Another object of the present invention is to provide a unique single axle wheel truck for railroad cars.

These and other objects, advantages and features shall hereinafter appear, and for the purposes of illustration, but not for limitation, an exemplary embodiment of the present invention is illustrated in the accompanying drawings.

DESCRIPTION OF THE DRAWINGS

FIG. 7 is a side view of an embodiment of the fifth wheel of the present invention.

FIG. 8 is an end view of the fifth wheel illustrated in FIG. 7.

FIG. 11 is a side cross-sectional partially fragmentary view of the wheel truck stabilizer beam key and stop arrangement of the present invention.

DETAILED DESCRIPTION OF THE PREFERRED EMBODIMENT

Figure 1:
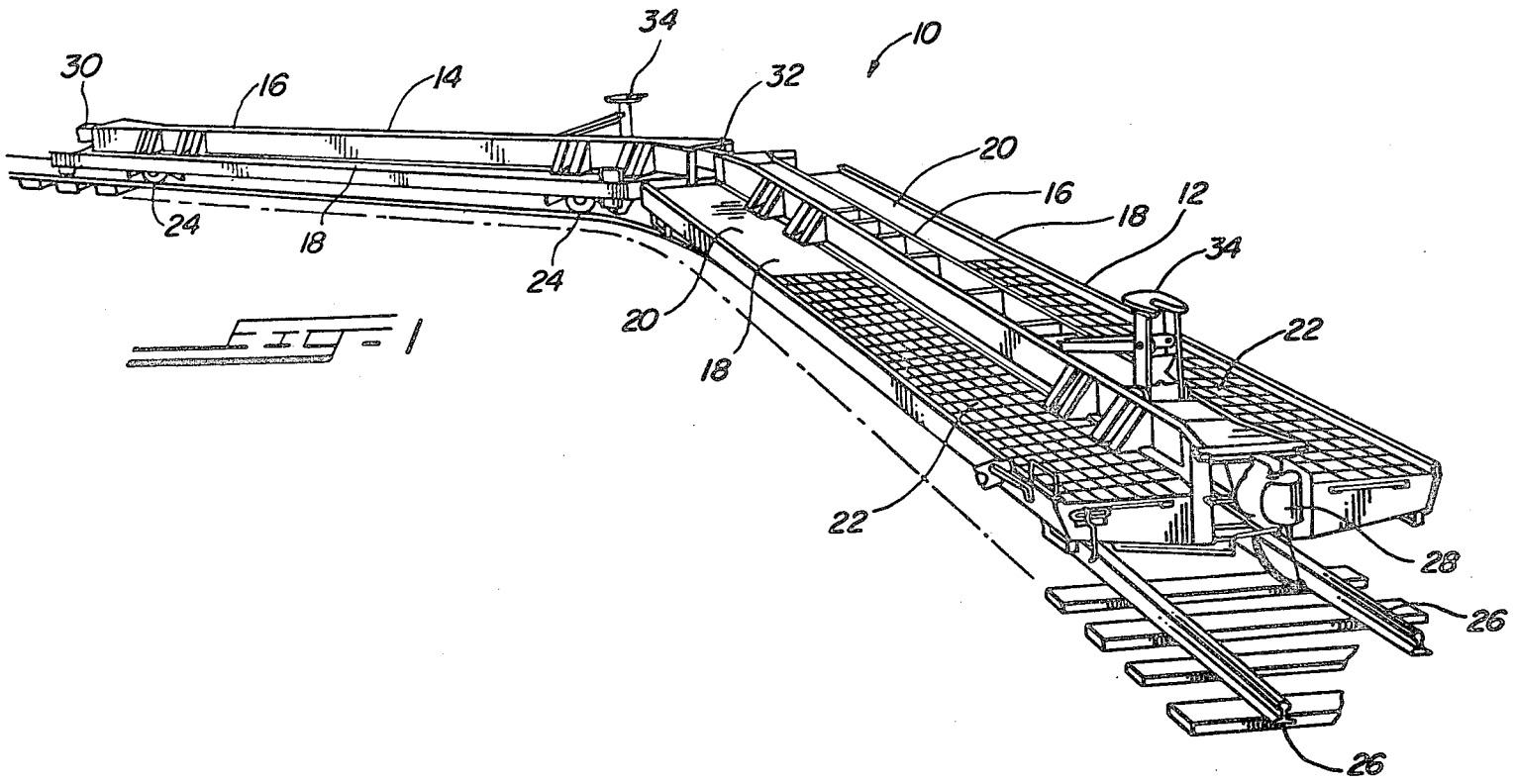
FIG. 1 is an upper left perspective view of an embodiment of an articulated rail car unit in accordance with the present invention.

With reference to FIG. 1, an articulated rail car unit in accordance with the present invention comprises rail car unit 10 having a first car body 12 and a second car body 14. Generally, first and second car bodies 12 and 14 comprise central spine structure 16 that extends the length of the car and tire support surfaces 18 extending outwardly from the central spine structure 16 at a level below the top of spine structure 16. The tire support surfaces 18 comprise flat solid metal surface portion 20 upon which the tires of wheeled vehicular truck trailers are supported. A grated surface portion 22, having holes therein to reduce the overall weight of the rail car, is provided for walking between the tire support surfaces 20.

The rail car unit 10 is supported by single axle railroad wheel trucks 24 which ride on railroad tracks 26. Mounted at the forward end of the first car body in the end of the central spine structure 16 is a conventional railroad coupling 28. A comparable conventional railroad coupling 30 is similarly mounted within the rearward end of the central spine structure 16 of the second car body 14. A semi-permanent coupling assembly 32 is connected between the central spine structures 16 of the first and second car bodies 12 and 14 at the rearward end of the first car body and forward end of the second body so that the two car bodies can be articulated with respect to one another as the rail car unit traverses around curves and bends in the track 26. The semi-permanent coupling assembly 32, unlike the conventional couplings 28 and 30, cannot be normally disengaged without complete disassembly. Accordingly, car bodies 12 and 14 act as a single articulated rail car unit.

First rail car body 12 and second rail car body 14 also each have a fifth wheel assembly 34 mounted on the central spine structure 16 toward the forward end of each car body. This fifth wheel assembly is specifically adapted to support the kingpin of wheeled vehicular truck trailers when placed upon the first and second car bodies 12 and 14.

Figures 2A, 2B:
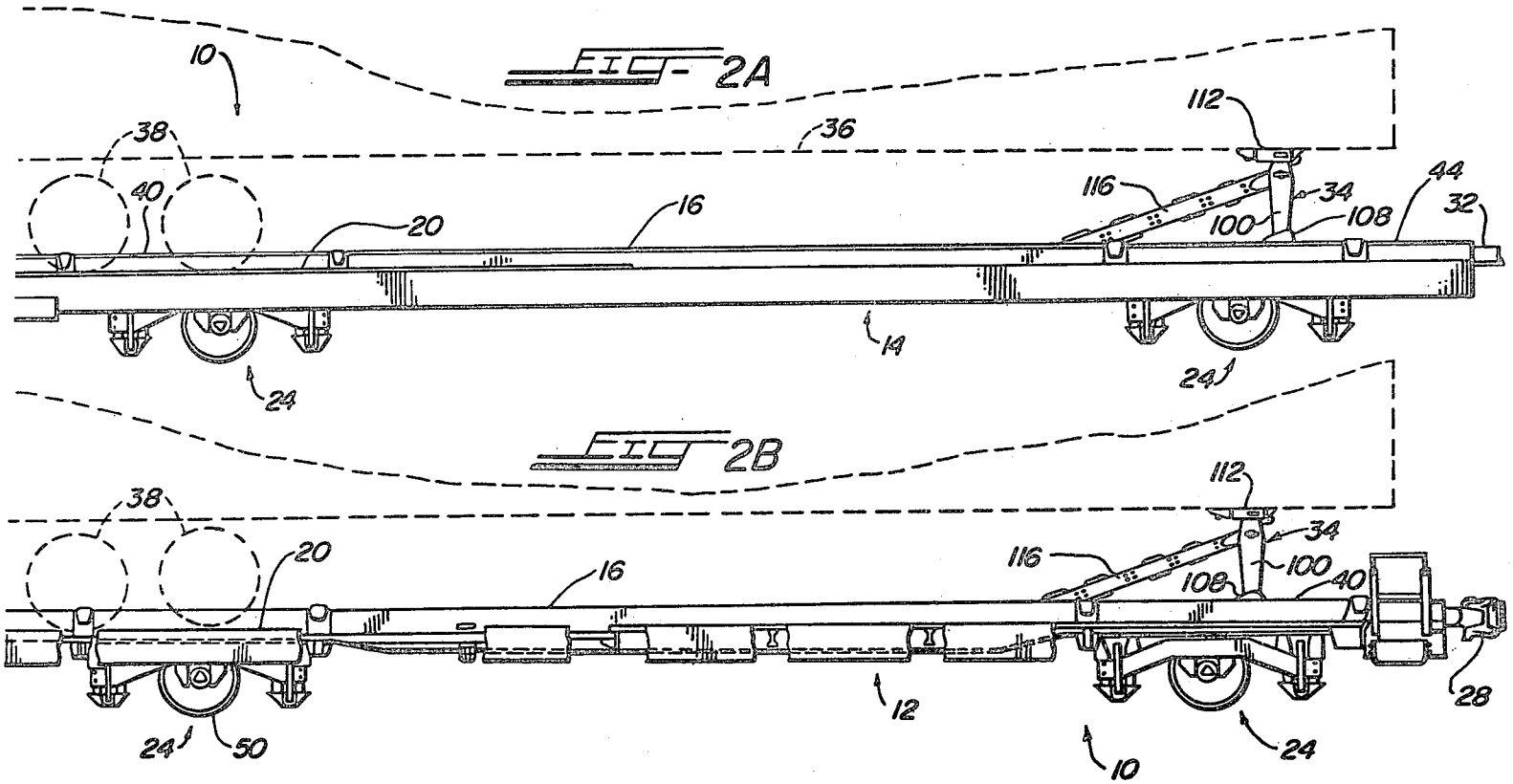
FIG. 2A and 2B are a side view of the articulated rail car unit in accordance with the present invention.

With more specific reference to FIGS. 2A and 2B, the first and second car bodies 12 and 14 are shown positioned one above the other in the drawing because of space limitation but ordinarily semi-permanent coupling 32 connects the two car bodies on a level plane. Shown in dotted lines in FIGS. 2A and 2B are the partial outline of conventional wheeled truck trailers 36 in the normal transporting position on car bodies 12 and 14. The wheels 38 of trailers 36 rest on the solid surface portion 20 of tire support surface 18. As can be seen, central spine structure 16 extends upwardly between the tires 38 so that the overall height of the rail car and truck trailer combination is lowered to allow easier passage under over track structures and through tunnels. Also, in FIG. 2A and 2B it can be seen that the fifth wheel assembly 34 supports the unwheeled end of the trailer 36. The exact configuration of fifth wheel assembly 34 will be described in more detail below.

Figure 3A:
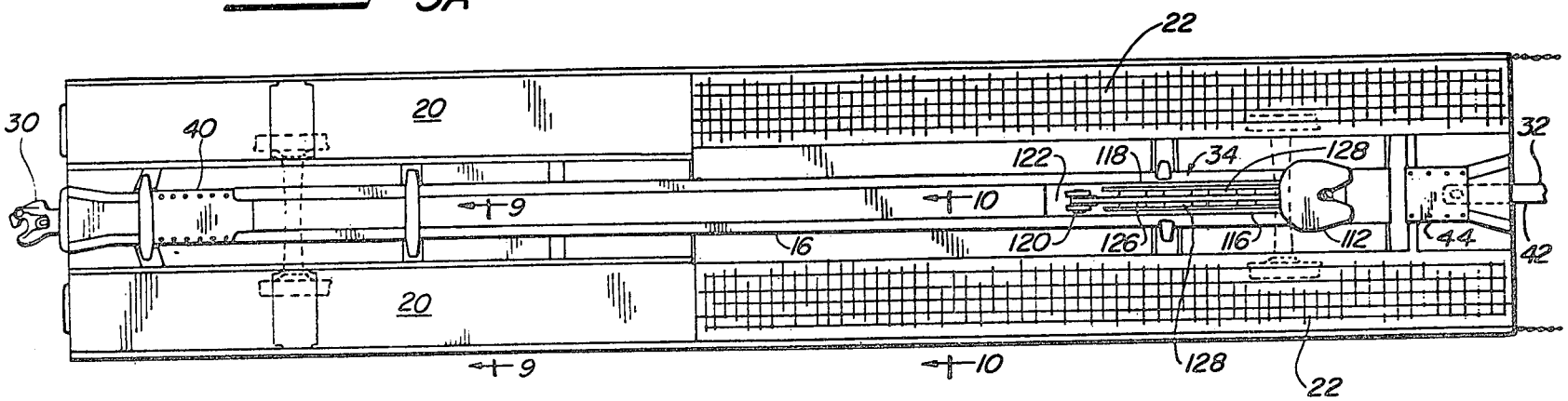
FIG. 3A and 3B are a top view of the articulated rail car unit illustrated in FIG. 2.
Figure 3B:
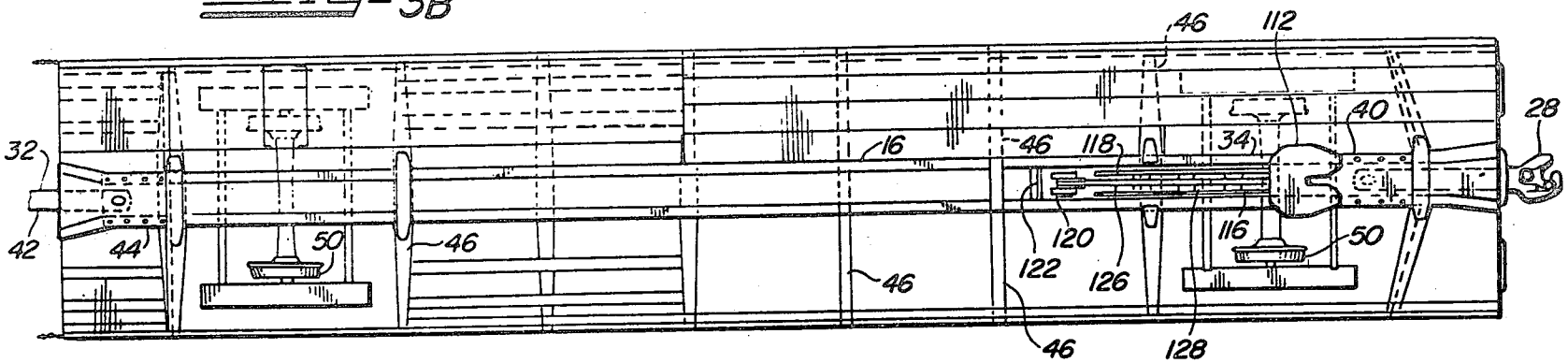
Figure 5:
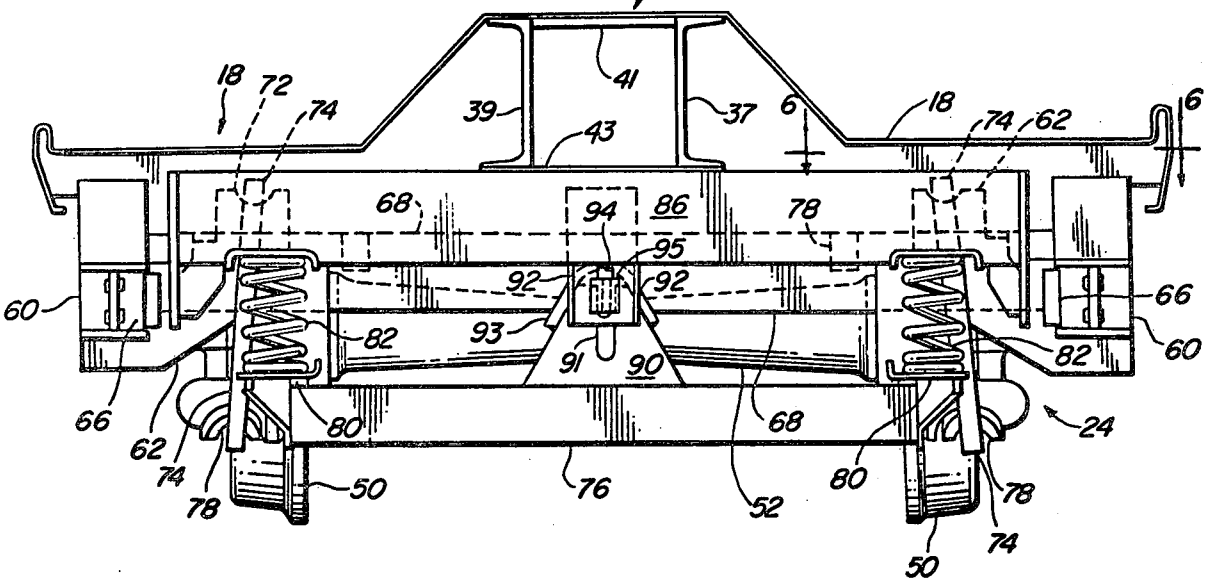
FIG. 5 is an end view of the single axle truck illustrated in FIG. 4.

With reference to FIG. 5, it can be seen that the central spine structure 16 comprises a channel beam assembly including channel beams 37 and 39 joined periodically at top and bottom by cross members 41 and 43 that extend the entire length of the car bodies. Mounted at each end of the car bodies to the spine structure 16 are the single axle truck assemblies 24. As can be seen in FIG. 3A and 3B, the couplings 28 and 30 and the semi-permanent coupling assembly 32 are also connected to the central spine structure 16 so that the central spine structure 16 forms the principal load bearing member providing vertical rigidity between the railroad wheel trucks and also a force transmitting path between the couplings.

Couplings 28 and 30 are conventional railroad couplings and comprise a conventional shock and load bearing draft gear (not shown) which is mounted within the interior of the spine structure 16. To facilitate the maintenance, repair and replacement of the draft gear of the couplings 28 and 30, removable plates 40 are mounted over the draft gears at the ends of spine structure 16. Thus, these plates 40 can be removed from the top to allow repair and maintenance of the draft gear from above. This is a substantial advantage over conventional rail cars which require access to the draft gear from below the car making repair and replacement far more difficult.

Similarly, semi-permanent coupling 32 comprises a coupling bar 42 which is mounted to the central spine structure 16 by conventional Waughmats (not shown) to provide a flexible shock and load absorbing connection. These Waughmats are positioned beneath removable plates 44 which are removable from the top of spine structure 16 to permit repair and/or replacement of the Waughmats. This top access similarly facilitates repair and maintenance of the Waughmats.

Figure 10:
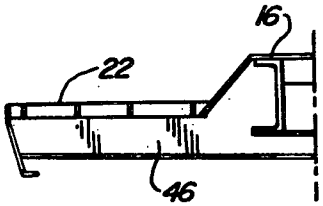
FIG. 10 is a cross-sectional view taken substantially along line 10—10 in FIG. 3A.
Figure 9:
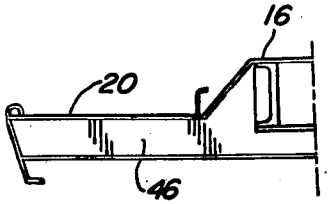
FIG. 9 is a cross-sectional view taken substantially along line 9—9 in FIG. 3A.

With reference to FIG. 3B and FIGS. 9 and 10, the tire supporting surface 18 is supported by outwardly extending ribs 46 which are welded to the central spine structure 16 and extend outwardly therefrom at periodic positions along spine structure 16. The solid surface portion 20 (see FIG. 9) and the grated surface portion 22 (see FIG. 10) are supported by the upper edge of the ribs 46.

Figure 4:
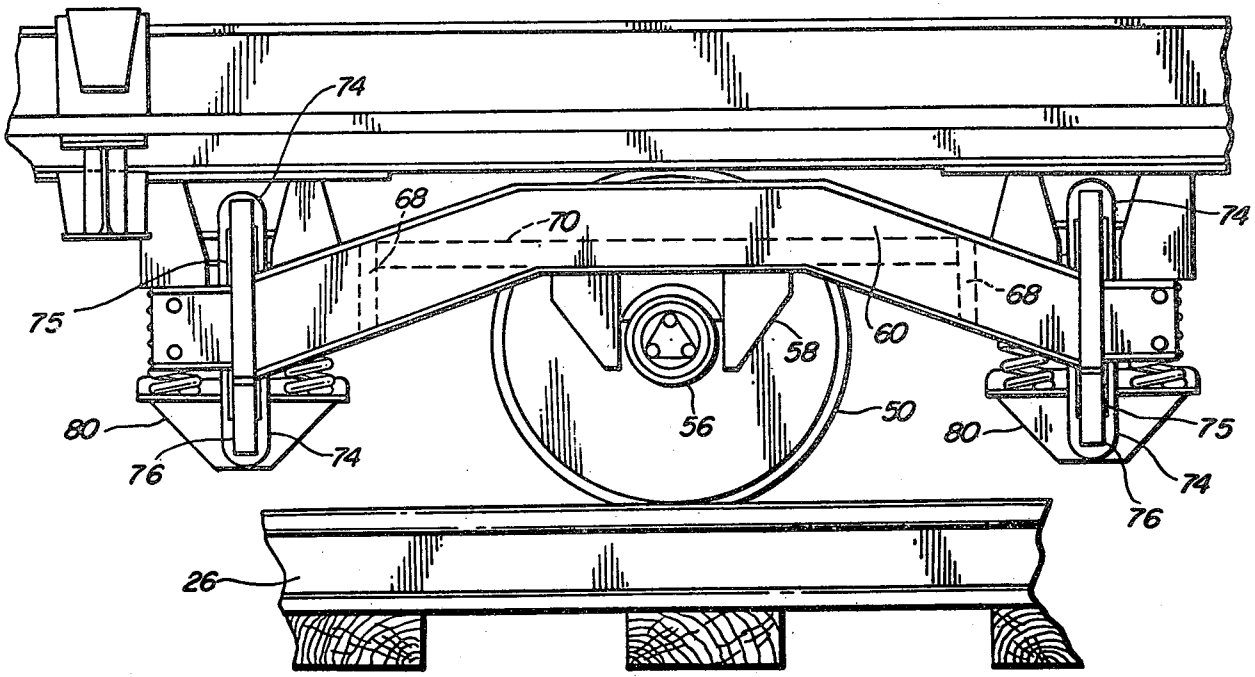
FIG. 4 is a side view of a single axle railroad wheel truck of the embodiment of the present invention.
Figure 6:
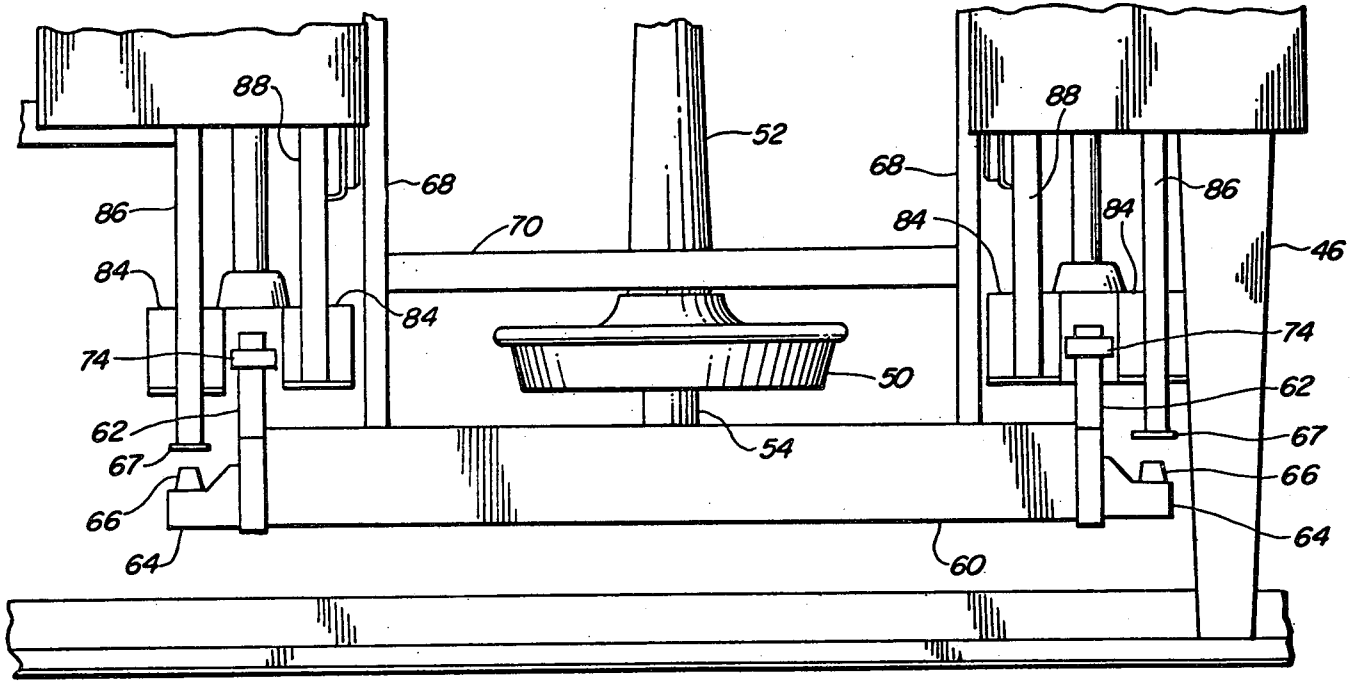
FIG. 6 is a top view taken substantially along line 6—6 in FIG. 5.

With reference to FIGS. 4, 5 and 6, the structure of the single axle wheel truck assemblies 24 is illustrated. Each of the assemblies 24 is the same so only one will be described. Single axle wheel truck assembly 24 comprises railroad wheels 50 joined together by axle 52 to form a unitary wheel structure. Extending outwardly from each end of wheels 50 is an axle extension 54 which extends into bearings 56 mounted in bearing block assemblies 58 that extend downwardly from side frames 60. Thus, wheels 50 are free to rotate within bearings 56 on track 26.

Mounted at each end of each side frame 60 and extending towards the center of the rail car are hangar flanges 62. Mounted at each end of side frame 60 and extending away from the ends thereof are snubber assemblies 64 which have a resilient pad 66 mounted thereon positioned to engaged snubber stop 67 to prevent lateral movement of the side frame more than a short distance. Side frames 60 are connected by cross struts 68 and cross struts 68 are supported by connecting members 70 which are welded between cross struts 68 to provide additional rigidity. Thus, a solid wheel supporting frame is formed comprising wheels 50 and axle 52 mounted in bearings 56 on side frames 60 rigidly joined by cross struts 68 and members 70. The four hanger flanges 62 are positioned at each corner of this frame. Flanges 62 have formed at the extended end thereof a semi-circular groove 72 over which is hung a hanger member 74. Member 74 has a central opening 75 therein which fits over the end of flange 62 and engages groove 72. Hangar 74 extends downwardly and opening 75 at the opposite end thereof is positioned over the end of a cross member 76 to engage a groove 78 (see FIG. 5).

Mounted on the top of cross members 76 are spring support brackets 80 which provide a platform for supporting the bottom end of compression springs 82. The top ends of compression springs 82 rest against upper spring support brackets 84 which are mounted on cross beams 86 and 88, respectively. Cross beams 86 are longer than cross beams 88 and mounted on the end thereof are the snubber stops 67, previously described. Cross beams 86 and 88 are mounted to the bottom of spine structure 16 to provide a solid base for the entire single axle wheel truck assembly 24.

With reference to FIG. 5, mounted at the center of cross members 76 and extending upwardly therefrom are stabilizing flanges 90. Each flange 90 has a vertical slot 91 and a cover strap 93 welded over the top of slot 91. Flange 90 slides vertically in a passageway between stabilizer plates 92 mounted on cross beams 86 and 88 (see FIG. 11) so that stabilizer flange 90 and cross member 76 can move vertically but cannot move longitudinally, twist or rotate. Stabilizer plates 92 have tapered slots 94 formed therein coincident with slot 91 in flange 90. A stop key 95 is inserted through slots 94 and 91 and retained by a cotter pin 96. Key 95 has an enlarged head 96 which prevents it from passing through slot 94. Key 95 prevents lateral movement of cross member 76. Also, key 95 will engage strap 93 and the bottom of slot 91 to prevent flange 90 and member 76 from moving vertically beyond set limits. This prevents hangers 74 from becoming disengaged from grooves 78 and 72 if for example the car was lifted off the tracks or compression of springs 82 is otherwise relieved.

As can be seen, the single axle truck assembly 24 provides very flexible suspension for the single axle wheels 50. Each of the four corners of the structure has a set of compression springs allowing the truck assembly to absorb a variety of different types of forces while maintaining the stability of the car.

With reference to FIGS. 7 and 8, an enlarged view of the fifth wheel assembly 34 is illustrated. Fifth wheel assembly 34 comprises two upwardly extending legs 100 and 102 which are pivotably mounted by pins 104 and 106 between flanges 108 and 110. Flanges 108 and 110 are welded to the top of central spine structure 16. Pivotably mounted to the top of legs 100 and 102 by pins 111 is a conventional base plate 112 which is adapted to receive and support the kingpin of a wheeled vehicular truck trailer 36.

Pivotably mounted to legs 100 and 102 by a pin 114 are arms 116 and 118 which extend toward flanges 120 which are welded to a base plate 122 welded between the I beams 37 and 39 of central spine structure 16. A pin 124 pivotably mounts an arm 126 to flange 120. Arm 126 extends between and parallel to arms 116 and 118.

A set of resilient pads 128 are connected between arms 116 and 118 and arm 126. These resilient pads allow arm 126 to move laterally with respect to arms 116 and 118 as legs 100 and 102 pivot about pin 104. Thus, resilient pads 128 act as cushioned shock absorbers to absorb the vibrational forces normally incident to the rapid movement of a rail car over railroad tracks thereby reducing the vibrational forces applied to any cargo contained in the wheeled vehicular trailers 36 carried by the rail car unit 10. Fifth wheel assembly 34 is not collapsible since in modern piggyback rail operations, truck trailers are loaded onto the rail car units by overhead lifting equipment rather than being driven onto the rail cars. Thus, it is not necessary to have the fifth wheel capable of being retracted so that a truck can be driven onto the rail car to pick up the trailer. Accordingly, the fifth wheel is designed to provide a more stable base for the trailer while also providing vibrational shock absorbing capabilities as described.

As can be seen from the foregoing, a unique rail car structure has been disclosed which permits the piggyback carrying of extremely large truck trailers (45 feet or longer) by a single centrally articulated rail car unit. Since single axle wheel trucks are utilized, the rail car unit 10 has the same total number of axles (four) per rail car unit that is normally provided on any single rail car thus holding cost and maintenance to a minimum. Further, the utilization of the central spine structure 16 as the principal load bearing member both vertically and transversely, the wheel support surface 18 can be lightened substantially and a portion made out of metal grating material to reduce the overall weight of the rail car unit and thereby increase the load that may be carried in the vehicular trailers 36.

Since the couplings are mounted in the central spine structure 16 above the wheel support surface, access to the couplings and to the draft gear and Waughmats can be achieved from above by removing a cover plate. This permits substantial advantages in maintenance and service. Moreover, the central spine structure 16 allows the tire support surface to be positioned below the level of spine structure 16 thereby reducing the total height of the combination of the rail car unit and transported trailer 36 so that it may more easily pass through tunnels and other overhead restricting structures.

As may be apparent to one skilled in the art, various changes, alterations, or modifications, may be made to the embodiment as disclosed and described herein without departing from the spirit and scope of the present invention as defined in the appended claims.

We claim:

1. A single axle railroad wheel truck for rail cars comprising:

two railroad wheels joined by an axle to form a wheel unit including axle extensions extending outwardly from said wheels;

bearing means rotatably supporting said axle extensions;

side frame means supporting said bearing means; means rigidly connecting said side frames;

a flange mounted at each end of said side frame means and extending therefrom;

hanger means engaging each of said flanges;

cross members positioned beneath said flanges, and each end of said cross members engaging a hanger means;

cross beams mounted to a lower surface of the rail car adjacent an end thereof;

spring means positioned between said cross beams and said cross members for flexing under the load and forces incident to travel over rail tracks, means for permitting said cross members to move vertically while preventing said cross members from moving longitudinally and preventing said cross members from rotating, wherein said means for permitting comprises a stabilizer flange mounted to and extending vertically from said cross members, a pair of stabilizer plates mounted on said cross beams and defining a vertically arranged passageway between said plates through which said stabilizer flange slides, said plates preventing longitudinal and rotational movement of said cross members while permitting vertical movement, and further comprising a vertically arranged slot in said stabilizer flange, tapered slots in said stabilizer plates coincident with said slot in said stabilizer flange, a key positioned through said slots in said stabilizer plates and through said slot in said stabilizer flange, said key preventing movement of said stabilizer flange and said cross member beyond predetermined limits.

* * * * *